US008591293B2

(12) United States Patent
Hosokawa et al.

(10) Patent No.: US 8,591,293 B2
(45) Date of Patent: Nov. 26, 2013

(54) POWER TOOL

(75) Inventors: Nobuhito Hosokawa, Ibaraki (JP); Shinji Kuragano, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 677 days.

(21) Appl. No.: 12/738,651

(22) PCT Filed: Nov. 21, 2008

(86) PCT No.: PCT/JP2008/071744

§ 371 (c)(1),
(2), (4) Date: Apr. 19, 2010

(87) PCT Pub. No.: WO2009/066798

PCT Pub. Date: May 28, 2009

(65) Prior Publication Data

US 2010/0210196 A1 Aug. 19, 2010

(30) Foreign Application Priority Data

Nov. 21, 2007 (JP) ..... 2007-301899
Feb. 19, 2008 (JP) ..... 2008-037863

(51) Int. Cl.
*B24B 55/05* (2006.01)

(52) U.S. Cl.
USPC ..... 451/452; 451/455; 451/359

(58) Field of Classification Search
USPC ..... 451/451, 452, 454, 455
See application file for complete search history.

(56) References Cited

U.S. PATENT DOCUMENTS

| | | | | |
|---|---|---|---|---|
| 5,351,368 | A * | 10/1994 | Borst | 24/270 |
| 6,688,955 | B2 * | 2/2004 | Ruey-Zon | 451/360 |
| 7,628,682 | B2 * | 12/2009 | Andrasic et al. | 451/451 |
| 2007/0298696 | A1 | 12/2007 | Blatz | |

FOREIGN PATENT DOCUMENTS

| | | | |
|---|---|---|---|
| CN | 2816444 | Y | 9/2006 |
| DE | 3638337 | A1 | 5/1988 |
| DE | 3919649 | A1 | 12/1990 |
| GB | 1 479 780 | | 7/1977 |
| JP | 63-120081 | A | 5/1988 |
| JP | H06-036764 | A | 5/1994 |
| JP | H09-141551 | A | 6/1997 |
| JP | 9-192977 | A | 7/1997 |

OTHER PUBLICATIONS

Chinese Office Action for the related Chinese Patent Application No. 200880117176.8 dated Aug. 3, 2011.

(Continued)

*Primary Examiner* — Dung Van Nguyen
(74) *Attorney, Agent, or Firm* — Kenealy Vaidya LLP

(57) ABSTRACT

According to an aspect of the present invention, there is provided a power tool including: a wheel guard detachably attached to an attachment portion of the power tool; a fastening portion connected to the wheel guard; and a manipulation lever connected to the fastening portion at one end thereof so that the fastening portion is fastened to or released from the attachment portion by operating the manipulation lever, wherein the manipulation lever is moved to a first position in which the fastening portion is fixed to the attachment portion and to a second position in which the fastening portion is pivotable with respect to the attachment portion, and wherein, when the manipulation lever is positioned at the first position, the other end of the manipulation lever is positioned at an outer circumference of the wheel guard.

7 Claims, 12 Drawing Sheets

(56) References Cited

OTHER PUBLICATIONS

Japanese Office Action for the related Japanese Patent Application No. 2008-037863 dated Jan. 4, 2012.

Japanese Office Action for the related Japanese Patent Application No. 2007-301899 dated Jan. 4, 2012.

International Search Report and Written Opinion Nov. 21, 2008.

Chinese Office Action for related Chinese Patent Application No. 200880117176.8 dated Apr. 12, 2012.

* cited by examiner

POWER TOOL

TECHNICAL FIELD

An aspect of the present invention relates to a power tool, and more particularly, to a wheel guard that covers a tool bit of a disc grinder and to a holding structure allowing attachment and detachment of a wheel guard.

BACKGROUND ART

A disc grinder is used, for example, to perform a grinding by rotating a tool bit thereof by means of a motor as a driving source. Grindstone, diamond wheel or the like is used as the tool bit. During the grinding operation, the tool bit of the disc grinder is partially covered with a wheel guard for safety measures.

FIG. 9 is a top plan view of a related-art wheel guard unit. As shown in FIG. 9, the related-art wheel guard unit is provided with a semicircular wheel guard 1 configured to cover approximately a half of a disc-shaped tool bit B and a fastening band 3. The fastening band 3 includes a half ring-shaped member 3A fixed to or formed integrally with the wheel guard 1 and another half ring-shaped member 3B configured to be separated from the half ring-shaped member 3A.

In the wheel guard unit shown in FIG. 9, one end of a manipulation lever 2 is pivotably attached, by means of a screw 4, to a lever holder 10 coupled to the wheel guard 1. A cam part is formed at a proximal end portion of the manipulation lever 2. The cam part is engaged with a bent portion 3*b*2 of the half ring-shaped member 3B of the fastening band 3. A screw 6 is inserted through another bent portion 3*b*1 of the half ring-shaped member 3B and a bent portion 3*a* of the half ring-shaped member 3A, and the screw 6 is screwed into a nut 1*a* welded to the bend portion 3*a* of the half ring-shaped member 3A.

When the manipulation lever 2 is pivoted about the screw 4 in an arrow-a direction in FIG. 9, the cam part of the manipulation lever 2 is pressed against the bent portion 3*b*2 of the half ring-shaped member 3B, and thus, the circumferential length of the fastening band 3 is decreased. Then, the fastening band 3 is fastened to an attachment shaft of a tool body 100 of, for example, a disc grinder, and thus, the wheel guard 1 is fixed.

When grinding an object material, it is necessary to adjust an acting portion of the tool bit (specifically, an acting position of the tool bit relative to the disc grinder body) according to the shapes of the object material, a portion to be ground in the object material, and a detail of the operation. When grinding the object material, the wheel guard 1 is fixed at the position as shown in FIG. 8A. When cutting the object material, the wheel guard 1 is fixed at the position as shown in FIG. 8B.

To adjust the relative position of the wheel guard 1 to the tool body 100 (the portion of the tool bit covered by the wheel guard 1), it is necessary to loosen the fastening of the wheel guard 1 and to rotate the wheel guard 1 around the attachment shaft of the tool body 100.

In this case, when the manipulation lever 2 is pivoted from the position (first position) as shown in FIG. 9 to a position (second position) about the screw 4 in the arrow-b direction, the pressing force of the fastening band 3 against the bent portion 3*b*2 by the cam part of the manipulation lever 2 is released. Then, the circumferential length of the fastening band 3 is increased and the fastening force of the fastening band 3 is released. As a result, the wheel guard 1 can be freely rotated around the attachment shaft.

In this way, the circumferential position of the wheel guard 1 is changed. Thereafter, when the manipulation lever 2 is pivoted about the screw 4 in the arrow-a direction to be positioned at the position shown in FIG. 9, the fastening band 3 is fastened again so that the wheel guard 1 is fixed at the changed position.

By the one-touch pivot operation of the manipulation lever 2, the wheel guard 1 can be easily fixed and released in a short time.

In some cases, the related-art wheel guard unit shown in FIG. 9 may be attached to the disc grinder body 100 to be used for cutting the object material X as shown in FIGS. 10A and 10B. In such a case, there is a possibility that the manipulation lever 2 comes into contact with the object material X as shown in FIG. 10A. In that case, the manipulation lever 2 may be caught at the object material X as shown in FIG. 10B, so that the manipulation lever 2 is released and the fastening force of the wheel guard 1 with respect to the tool body 100 becomes weak. As a result, the wheel guard is unintendedly rotated during operation, and thus, the operability deteriorates.

Generally, a wheel guard unit of a disc grinder as shown in FIG. 17 is known. In the wheel guard unit, a wheel guard 101 is attached to a disc grinder body by fastening a fastening band 103 with screws 106.

As shown in FIG. 18, a wheel guard unit of a disc grinder according to another related art is illustrated. The wheel guard unit is provided with a position adjustment mechanism, in which a fulcrum shaft 104 of a lever 102 is fixed to a wheel guard 101 by means of a screw pin 105, and is attached to a disc grinder body.

Generally, when a disc grinder switches from a grinding operation in which a grindstone is attached thereto as a tool bit to a cutting operation, as regulated by the Japanese Regulations for Industrial Safety and Health and the Japanese Structural Standard of Disc Grinder, it is necessary to switch from a wheel guard configured to cover a single surface of the grindstone to a wheel guard configured to cover both surfaces of the grindstone.

However, the wheel guard 101 shown in FIG. 17 is inconvenient to use because it is necessary to use a tool such as a plus driver to loosen the screws 106 in order to detach the wheel guard.

In the wheel guard holding structure using the lever 102 shown in FIG. 18, the fastening force of the wheel guard 101 with respect to a power tool body of, for example, a disc grinder, can be easily adjusted by merely operating the lever 102. Here, the dimensional difference of the fastening band 103 between when fastening and when loosening is maintained, and the lever 102 is used to decrease/increase the fastening force of the fastening band 103. However, it is difficult to secure a sufficient dimensional difference enough for the wheel guard 101 to be smoothly detached: because of the limitation in an elastic deformation amount of the fastening band 103. For this reason, similar to the wheel guard 101 shown in FIG. 17, it is inconvenient to use because it is necessary to loosen the screws 106 in order to detach the wheel guard 101, in addition to the operation of the lever 102.

Furthermore, in the related-art wheel guard unit shown in FIGS. 17 and 18, similar labors as the detachment are required when the wheel guard 101 is attached to the power tool body, and it is inconvenient to use.

The related-art disc grinders are shown in, for example, JP-H09-141551-A and JP-UM-H06-036764-A.

DISCLOSURE OF THE INVENTION

An object of the present invention is to provide a power tool capable of preventing any deterioration in the operability under any operation conditions and allowing an operator to easily adjust the position of a wheel guard.

According to an aspect of the present invention, there is provided a power tool including: a wheel guard that is detachably attached to an attachment portion of the power tool having a tool bit that is driven to rotate; a fastening portion that is connected to the wheel guard; and a manipulation lever that is connected to the fastening portion at one end of the manipulation lever so that the fastening portion is fastened to or released from the attachment portion by operating the manipulation lever, wherein the manipulation lever is moved to a first position in which the fastening portion is fixed to the attachment portion and to a second position in which the fastening portion is pivotable with respect to the attachment portion, and wherein, when the manipulation lever is positioned at the first position, the other end of the manipulation lever is positioned at an outer circumference of the wheel guard.

The fastening portion may have a projection portion extending therefrom in a direction approximately perpendicular to the attachment portion. The projection portion may come into contact with an object material to isolate the manipulation lever therefrom.

The fastening portion may be connected to the wheel guard by a threading member. The fastening portion may have a guide portion that is provided to restrict a movement of the manipulation lever in a threading direction of the threading member.

According to such structure, it is possible to prevent the manipulation lever from coming into contact with the object material, thereby preventing the fastening force of the wheel guard from weakening. Moreover, even when the positional relationship between the wheel guard and the power tool body is changed, an operator can easily operate the manipulation lever. Therefore, it is possible to provide a power tool having excellent workability without any deterioration in the operability.

Further, it is possible to prevent the manipulation lever from coming into contact with the object material to be worn away, thereby preventing the fastening force of the wheel guard from weakening.

Furthermore, it is possible to prevent the manipulation lever from moving in the threading direction, thereby preventing the fastening force of the wheel guard from weakening.

Another object of the present invention is to provide a power tool having a wheel guard holding structure allowing a wheel guard to be attached and detached to and from a power tool body without using an additional tool and preventing the wheel guard from be detached from the power tool body even when an attachment-detachment lever of the wheel guard is unintendedly moved in response to vibration or the like during the use of the power tool.

The power tool may further include: an attachment-detachment lever that is provided to the fastening portion or the wheel guard. The attachment-detachment lever may be operated to attach or detach the wheel guard.

To attach or detach the wheel guard, the attachment-detachment lever may be operated after the manipulation lever is operated.

A latch margin of the attachment-detachment lever with respect to the fastening portion may be set large enough for the wheel guard to not be detached when the attachment-detachment lever is unintendedly moved.

According to such structure, it is possible to attach and detach the wheel guard to the power tool without using an additional tool during wheel guard replacement operations when a grindstone for plane grinding is replaced with a grindstone for cutting, or vice versa.

Further, even when the fastening force of the fastening band is set strong so that the wheel guard as a safety device is not easily detached, the attachment-detachment lever can be easily operated by operating another lever, so that an operator can operate the attachment-detachment lever with a relatively small force.

Furthermore, it is possible to prevent the wheel guard from being detached even when the attachment-detachment lever is unintendedly operated in response to vibration or the like during the use of the tool.

BEST MODE FOR CARRYING OUT THE INVENTION

[First Embodiment]

A first embodiment of the present invention will be described with reference to FIGS. 1A to 4. It is to be noted that redundant description will be omitted for those components having the same structure as the related art.

Figure 1A:
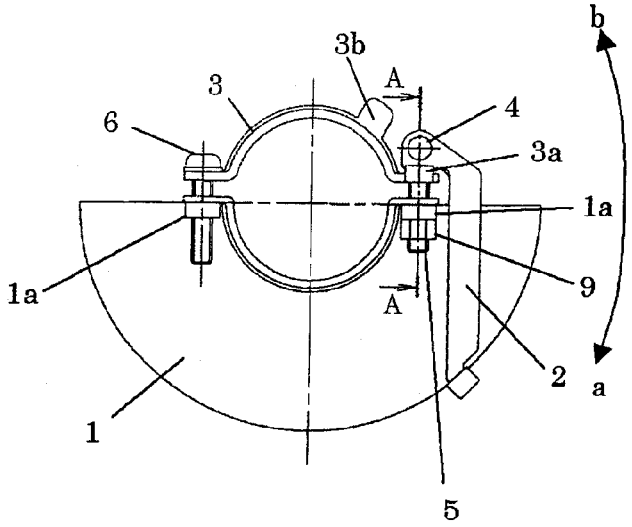
FIGS. 1A and 1B are a top plan view and a side view, respectively, of a wheel guard according to a first embodiment of the present invention.
Figure 1B:
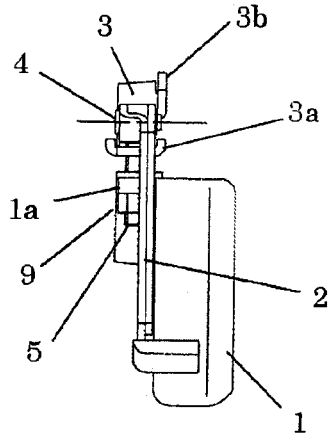
Figure 2:
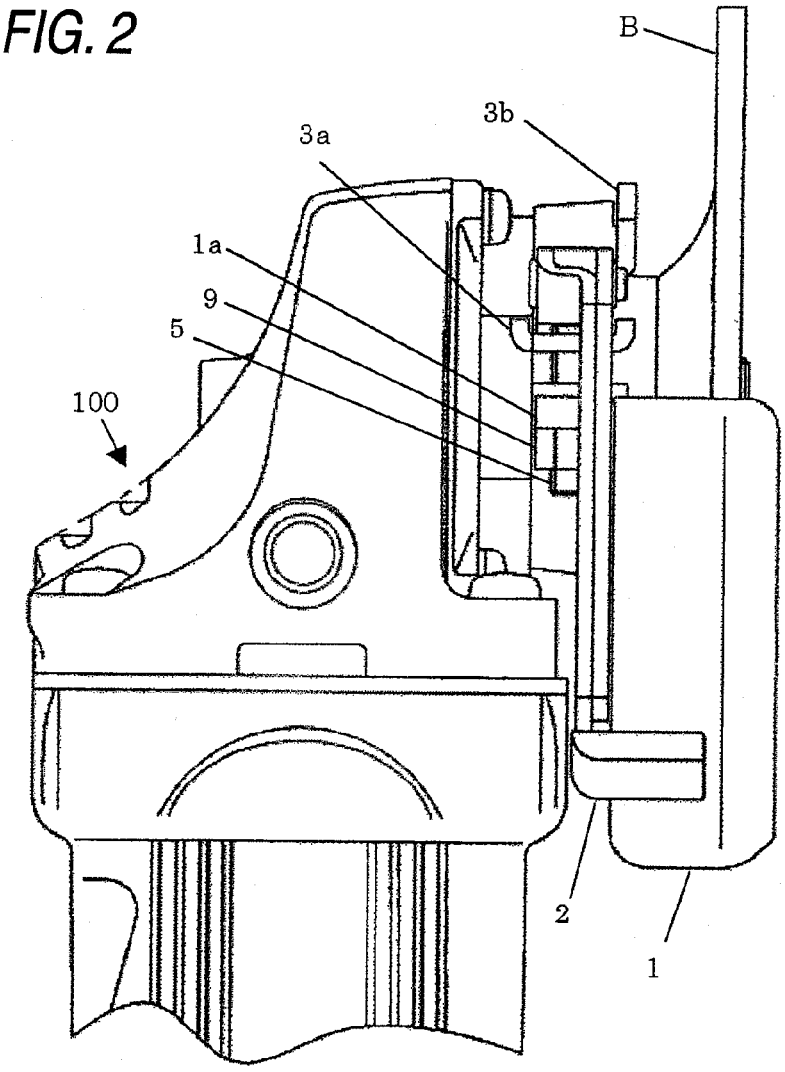
FIG. 2 is a view showing a state where the wheel guard shown in FIGS. 1A and 1B is attached to a disc grinder.
Figure 3:
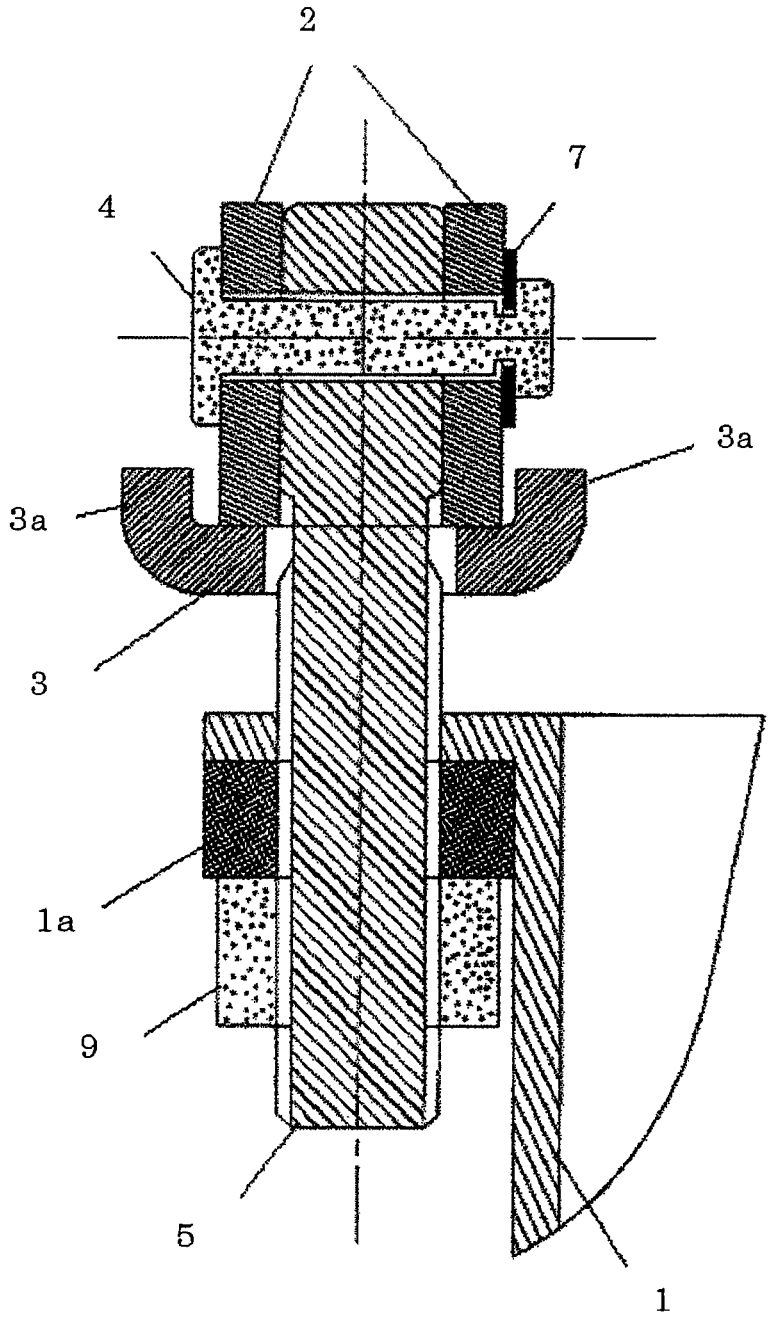
FIG. 3 is an enlarged cross-sectional view taken along the line A-A in FIG. 1A.
Figure 4:
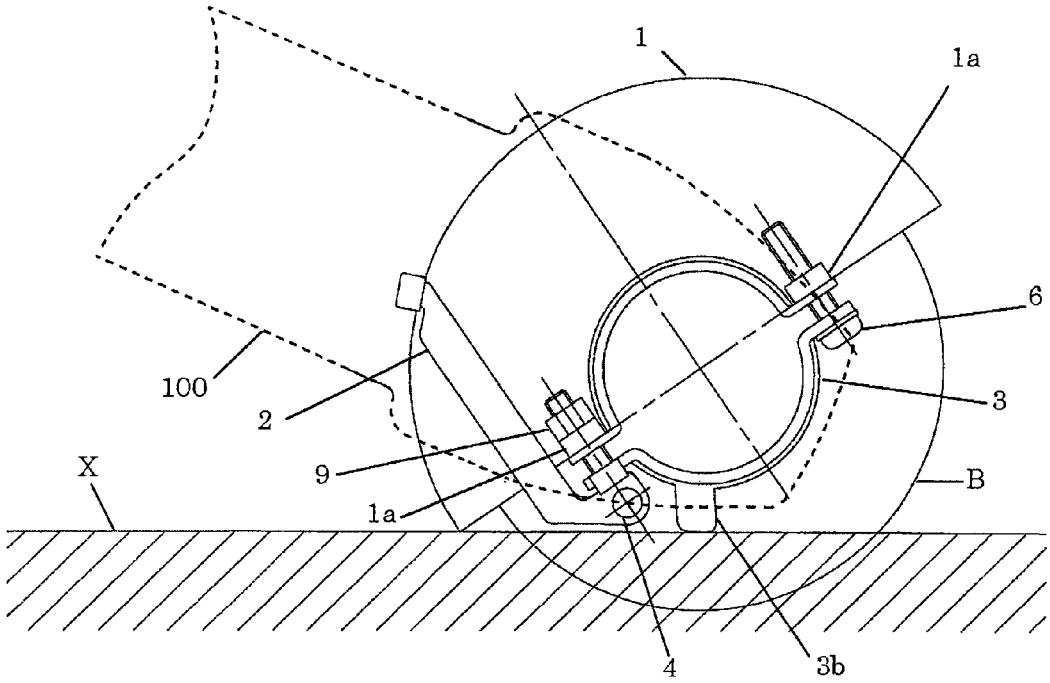
FIG. 4 is a view for explaining an operation using the wheel guard according to the first embodiment.

FIG. 1A is a top plan view of a wheel guard according to the first embodiment, and FIG. 1B is a side view of the wheel guard according to the first embodiment. FIG. 2 is a view showing a state where the wheel guard shown in FIGS. 1A and 1B is attached to a disc grinder. FIG. 3 is an enlarged cross-sectional view taken along the line A-A in FIG. 1A. FIG. 4 is a view for explaining an operation using the wheel guard according to the first embodiment.

The position of a manipulation lever 2 shown in FIG. 1A corresponds to a first position. When the manipulation lever 2 is pivoted in the arrow-b direction in FIG. 1A from the first position, the manipulation lever 2 comes to a second position in which a fastening band 3 is pivotable with respect to an attachment shaft of a tool bit B provided to a tool body 100.

In the embodiment, as shown in FIGS. 1A, 1B and 2, the other end of the manipulation lever 2 is positioned at the outer circumference of the wheel guard 1. Owing to such a configuration, the manipulation lever 2 is prevented from being pivoted by coming into contact with an object material or the like during operation. Therefore, it is possible to prevent the fastening force of the wheel guard 1 from weakening. Furthermore, an operator can easily operate the manipulation lever 2 even when the positional relationship between the wheel guard 1 and the power tool body 100 is changed. Therefore, it is possible to provide a power tool having excellent workability without deteriorating the operability.

Moreover, as shown in FIG. 4, a projection portion 3*b* is provided on the fastening band 3 to extend in a direction approximately perpendicular to the attachment shaft of the tool bit B. Since the projection portion 3*b* makes contact with an object material X processed by the tool bit B, the manipulation lever 2 is separated from the object material X, and thus, they might not come into direct contact with each other. Therefore, it is possible to prevent the manipulation lever 2 from coming into contact with the object material X to be worn away, thereby preventing the fastening force of the wheel guard 1 from weakening.

Furthermore, as shown in FIG. 3, a guide portion 3*a* is provided to the fastening band 3 to prevent the manipulation lever 2 from moving from a preset position and to prevent a fastening or releasing force from being changed from an appropriate strength. By providing the guide portion 3*a*, it is possible to restrict the movement of the manipulation lever 2 in the threading direction of the screw pin 5. Moreover, a retaining nut 9 is fastened to the screw pin 5 so as to oppose a nut la, and thus, the movement of the manipulation lever 2 in the threading direction of the screw pin 5 is strongly restricted. Therefore, it is possible to certainly prevent the manipulation lever 2 from moving in the threading direction of the screw pin 5, thereby preventing the fastening force of the wheel guard 1 from weakening.

[Second Embodiment]

Next, a second embodiment of the present invention will be described with reference to FIGS. 5A to 7.

Figure 5A:
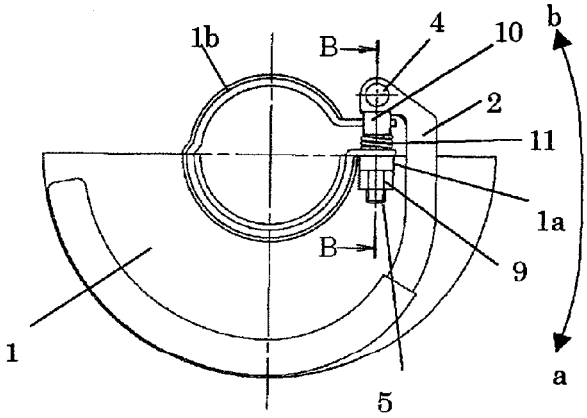
FIGS. 5A and 5B are a top plan view and a side view, respectively, of a wheel guard according to a second embodiment of the present invention.
Figure 5B:
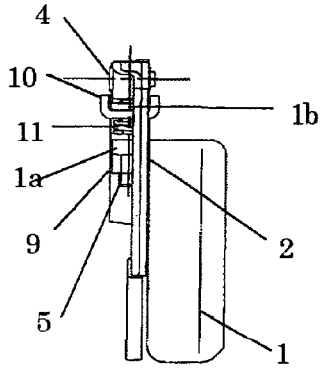
Figure 6:
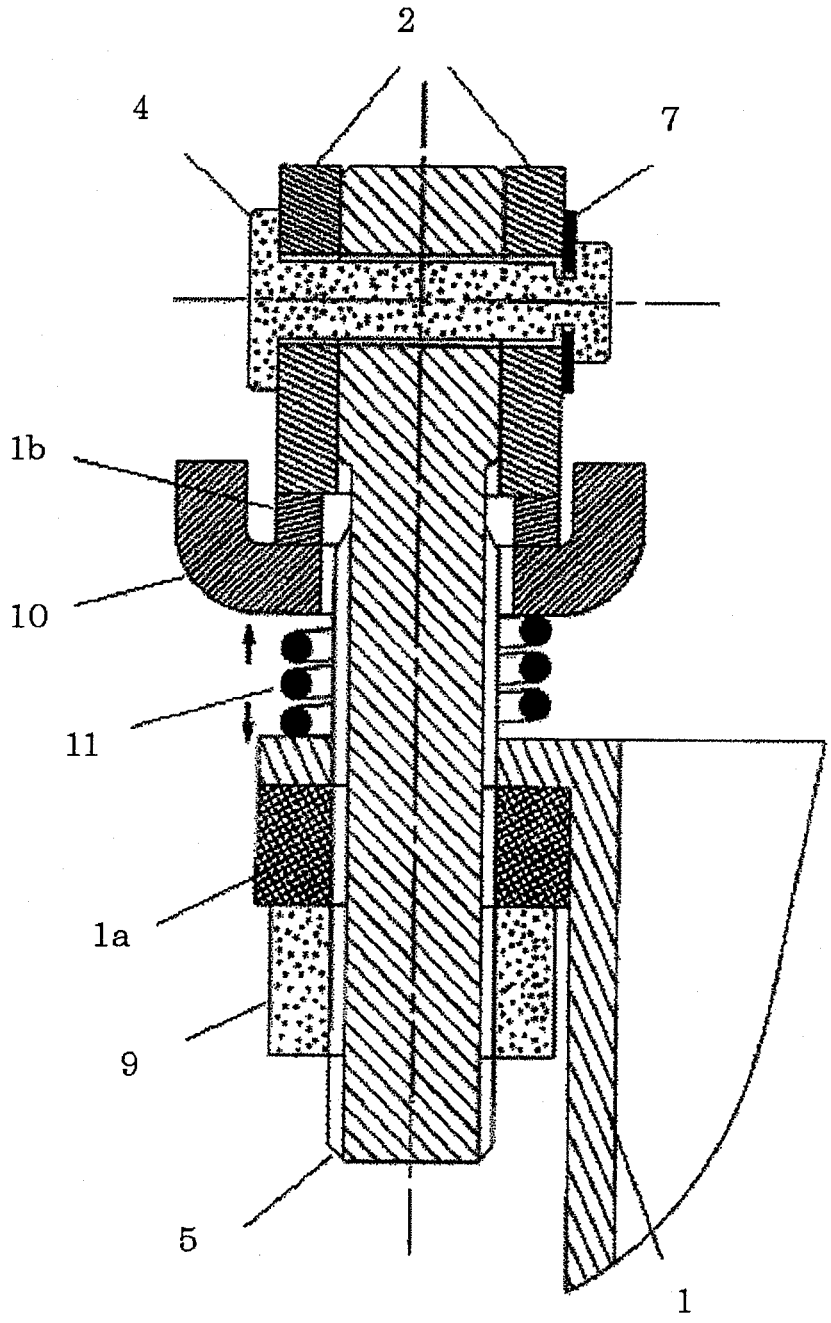
FIG. 6 is an enlarged cross-sectional view taken along the line B-B in FIG. 5A.
Figure 7:
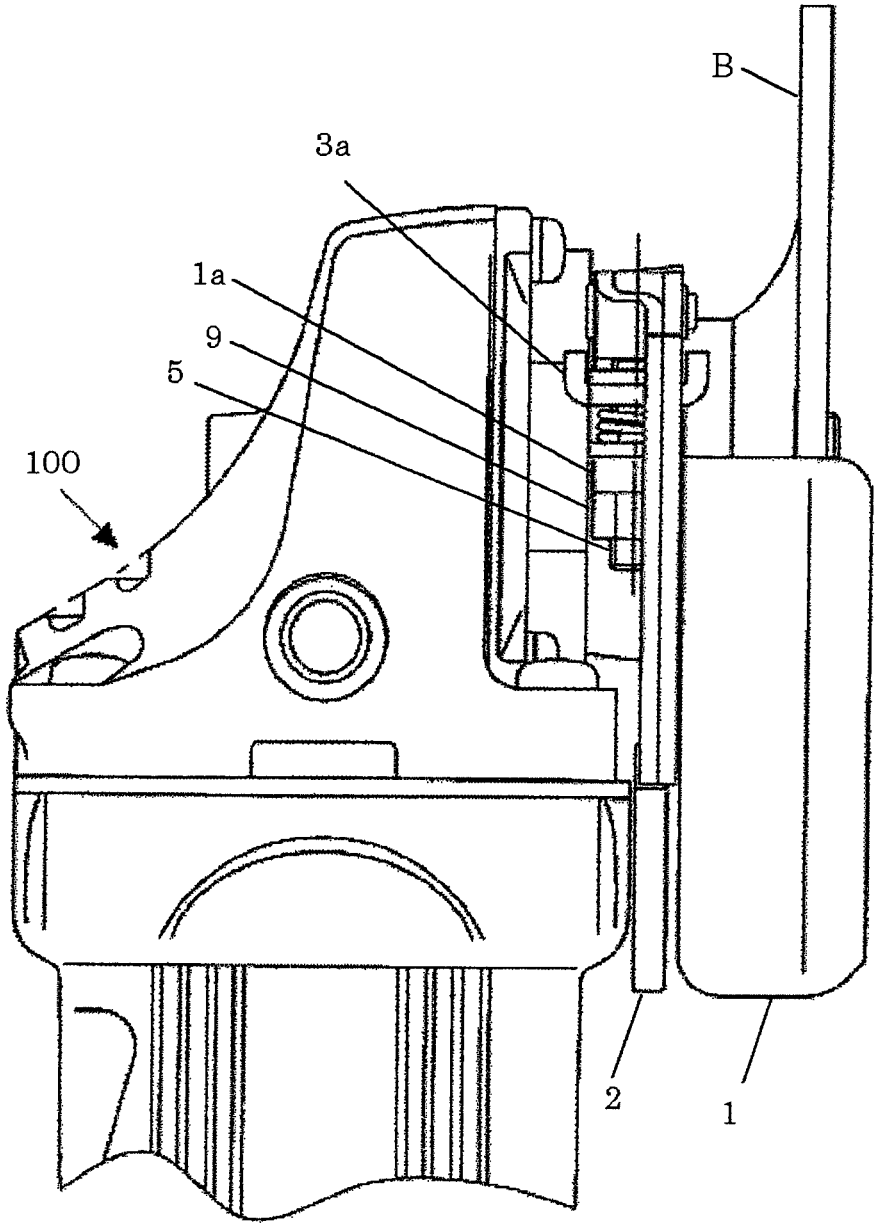
FIG. 7 is a view showing a state where the wheel guard shown in FIGS. 1A and 1B is attached to a disc grinder.
Figure 8A:
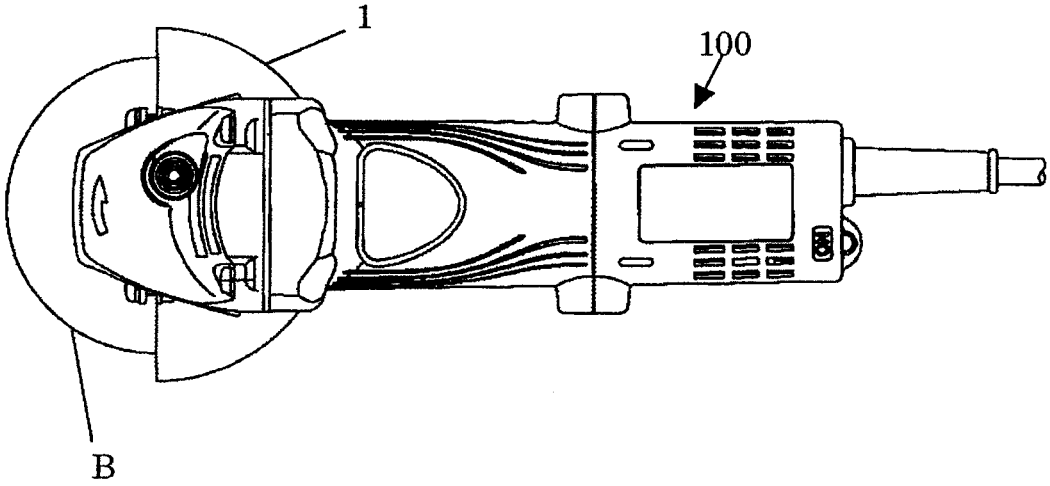
FIGS. 8A and 8B are views showing different fixed positions of the wheel guard of the disc grinder.
Figure 8B:
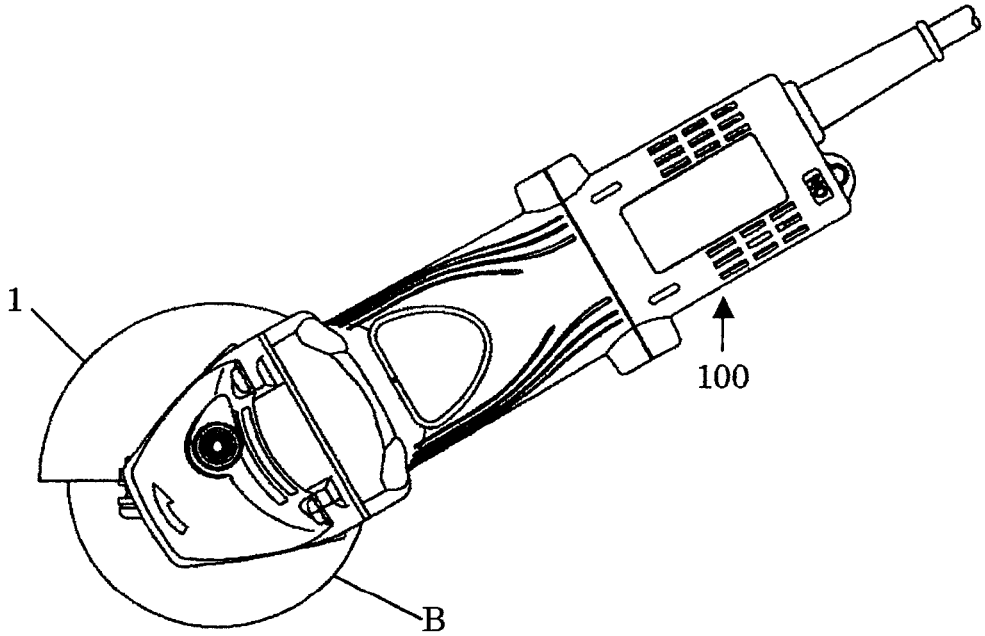
Figure 9:
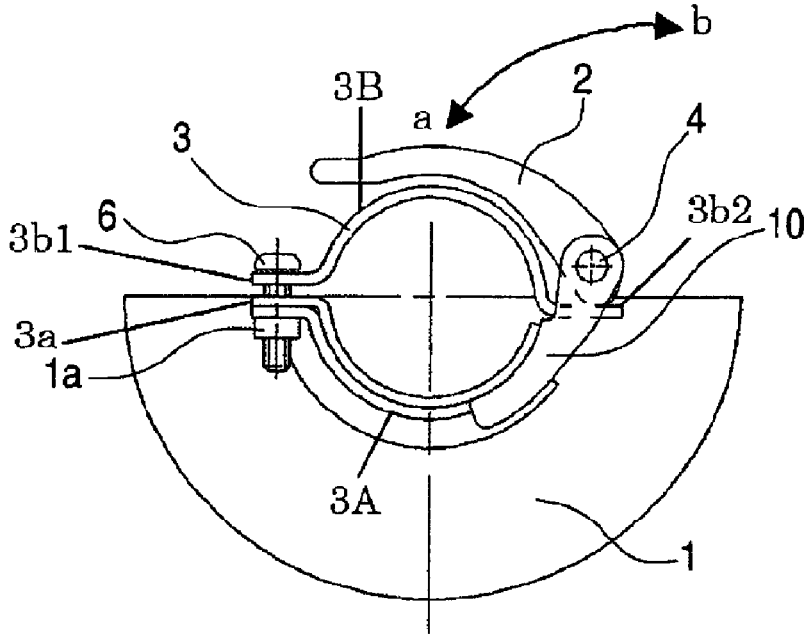
Fig. 9 Related Art
FIG. 9 is a top plan view of a related-art wheel guard unit.
Figure 10A:
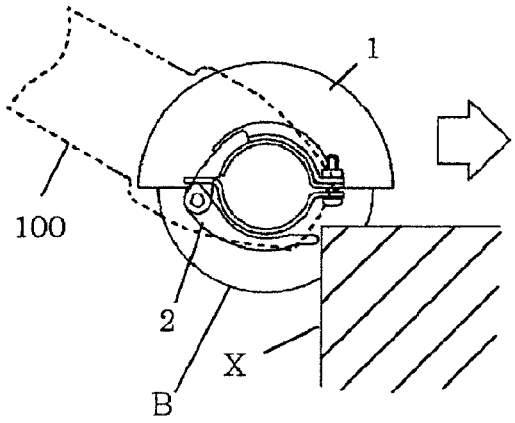
Fig. 10A Related Art
FIGS. 10A and 10B are views for explaining an operation using the related-art wheel guard unit.
Figure 10B:
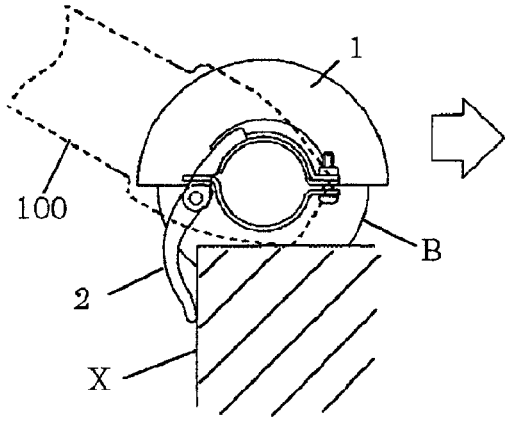
Fig. 10B Related Art

FIG. 5A is a top plan view of a wheel guard according to the second embodiment, and FIG. 5B is a side view of the wheel guard according to the second embodiment. FIG. 6 is an enlarged cross-sectional view taken along the line B-B in FIG. 5A. FIG. 7 is a view showing a state where the wheel guard shown in FIGS. 5A and 5B is attached to a disc grinder.

The position of a manipulation lever 2 shown in FIG. 5A corresponds to a first position. When the manipulation lever 2 is pivoted in the arrow-b direction in FIG. 5A from the first position, the manipulation lever 2 comes to a second position in which a fastening band 3 is pivotable with respect to an attachment shaft of a tool bit B provided to a tool body 100.

In the embodiment, the manipulation lever 2 is provided along with the outer circumference of the wheel guard 1. Owing to such a configuration, the manipulation lever 2 is prevented from being pivoted by coming into contact with an object material or the like during operation. Therefore, it is possible to prevent the fastening force of the wheel guard 1 from weakening. Furthermore, an operator can easily operate the manipulation lever 2 even when the positional relationship between the wheel guard 1 and the power tool body 100 is changed. Therefore, it is possible to provide a power tool having excellent workability and without deteriorating the operability.

Moreover, as shown in FIGS. 5A and 5B, the wheel guard 1 is fixed to the fastening band 3 by threading the fastening band 3 at one location. For this reason, a spring 11 is provided between the guide portion 3*a* and the wheel guard 1. By providing the spring 11, it is possible to finely adjust the position of the manipulation lever 2 by adjusting the vertical position of the guide 10 in FIG. 7.

[Third Embodiment]

Next, a third embodiment of the present invention will be described with reference to FIGS. 11 to 16.

Figure 11:
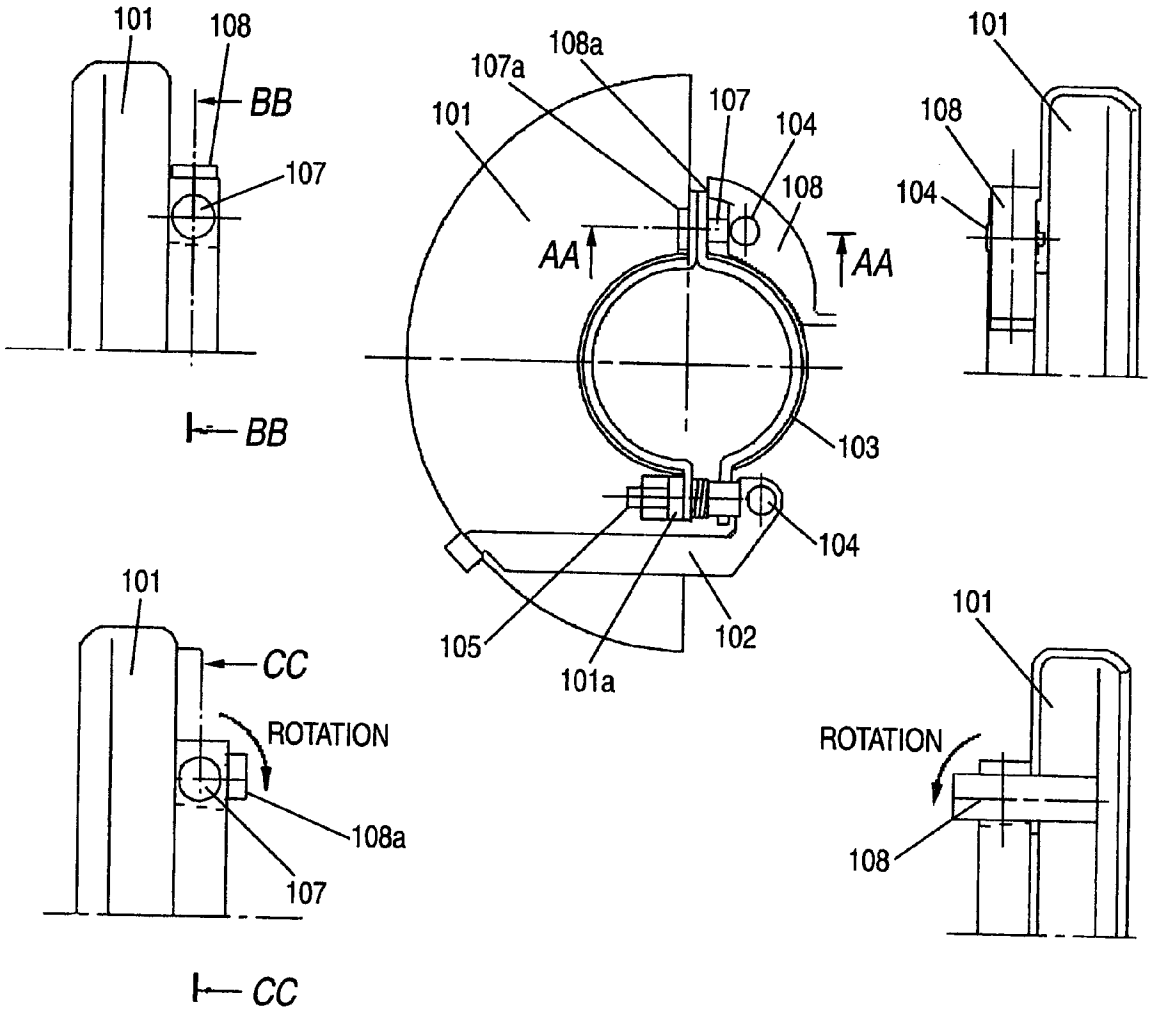
FIG. 11 illustrates a wheel guard holding structure according to a third embodiment of the present invention, configured to allow attachment and detachment of a wheel guard, which is an improvement of the wheel guard holding structure shown in FIG. 18.
Figure 12:
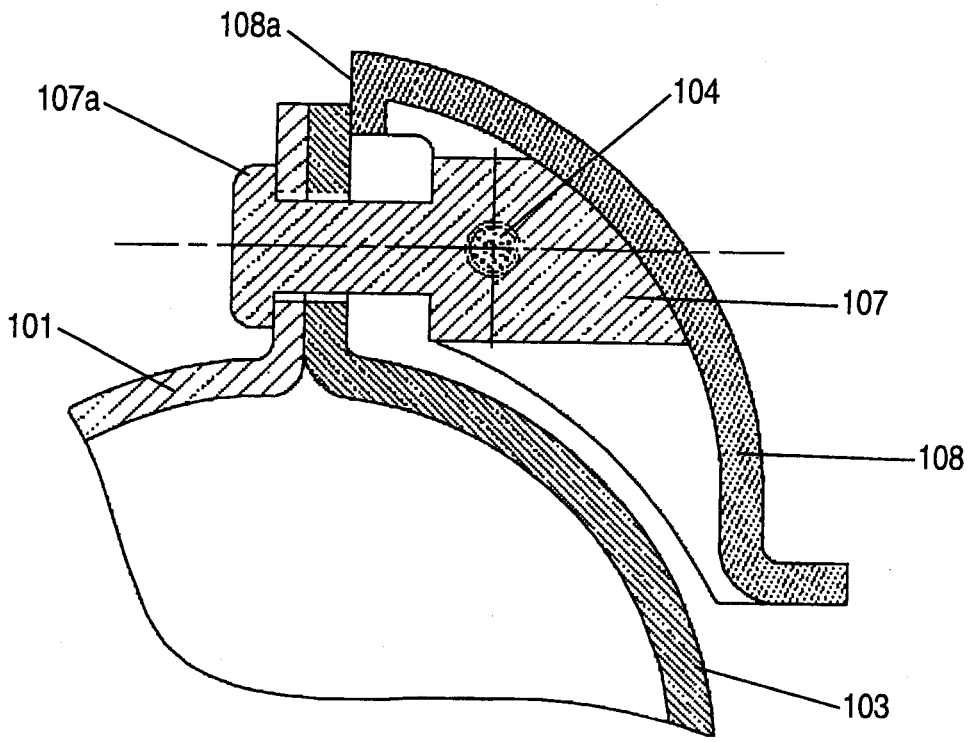
FIG. 12 is an enlarged cross-sectional view of the wheel guard holding structure taken along the line AA-AA in FIG. 11 when the wheel guard is attached thereto.
Figure 13:
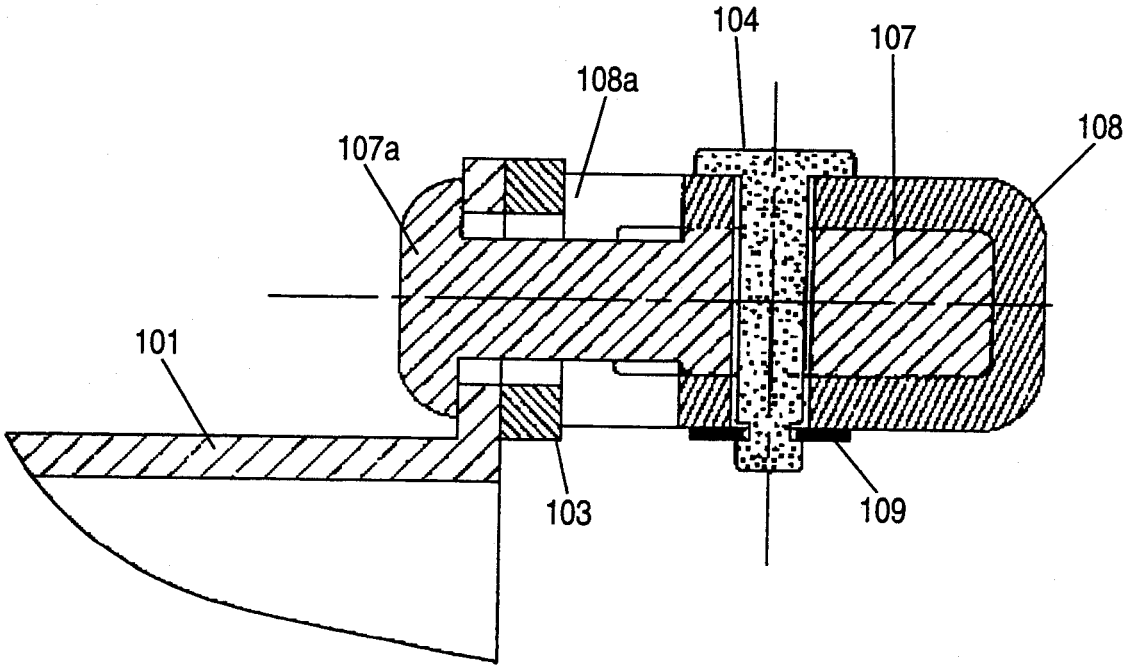
FIG. 13 is an enlarged cross-sectional view of the wheel guard holding structure taken along the line BB-BB in FIG. 11 when the wheel guard is attached thereto.
Figure 14:
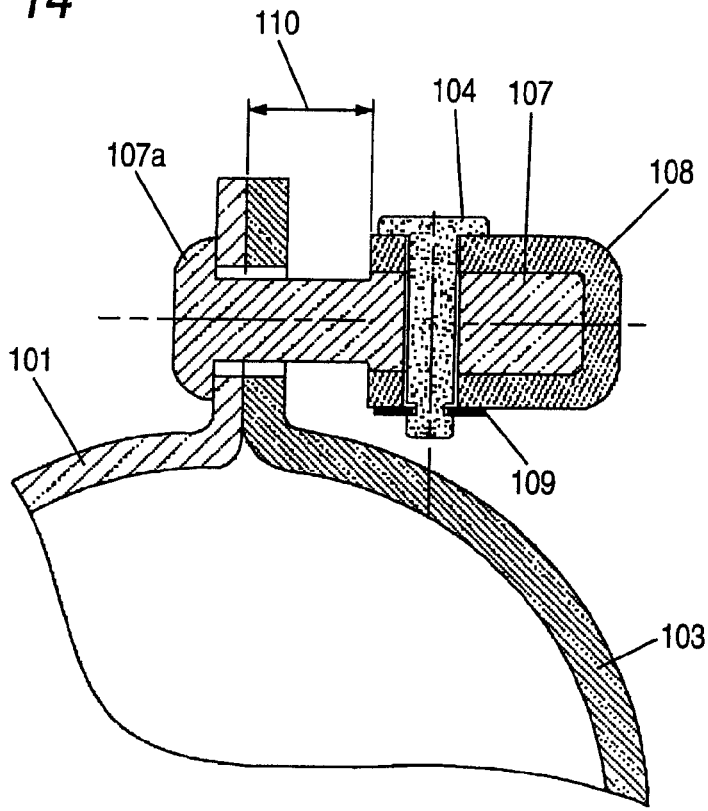
FIG. 14 is an enlarged cross-sectional view of the wheel guard holding structure taken along the line CC-CC in FIG. 11 when the wheel guard is detached therefrom.
Figure 15:
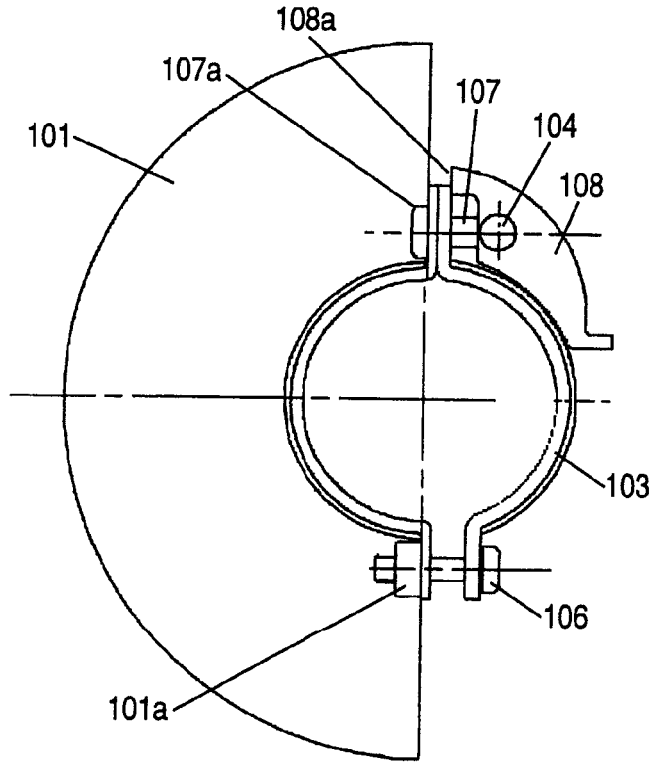
FIG. 15 illustrates a wheel guard holding structure according to the third embodiment, configured to allow attachment and detachment of a wheel guard, which is an improvement of the wheel guard holding structure shown in FIG. 17.
Figure 16:
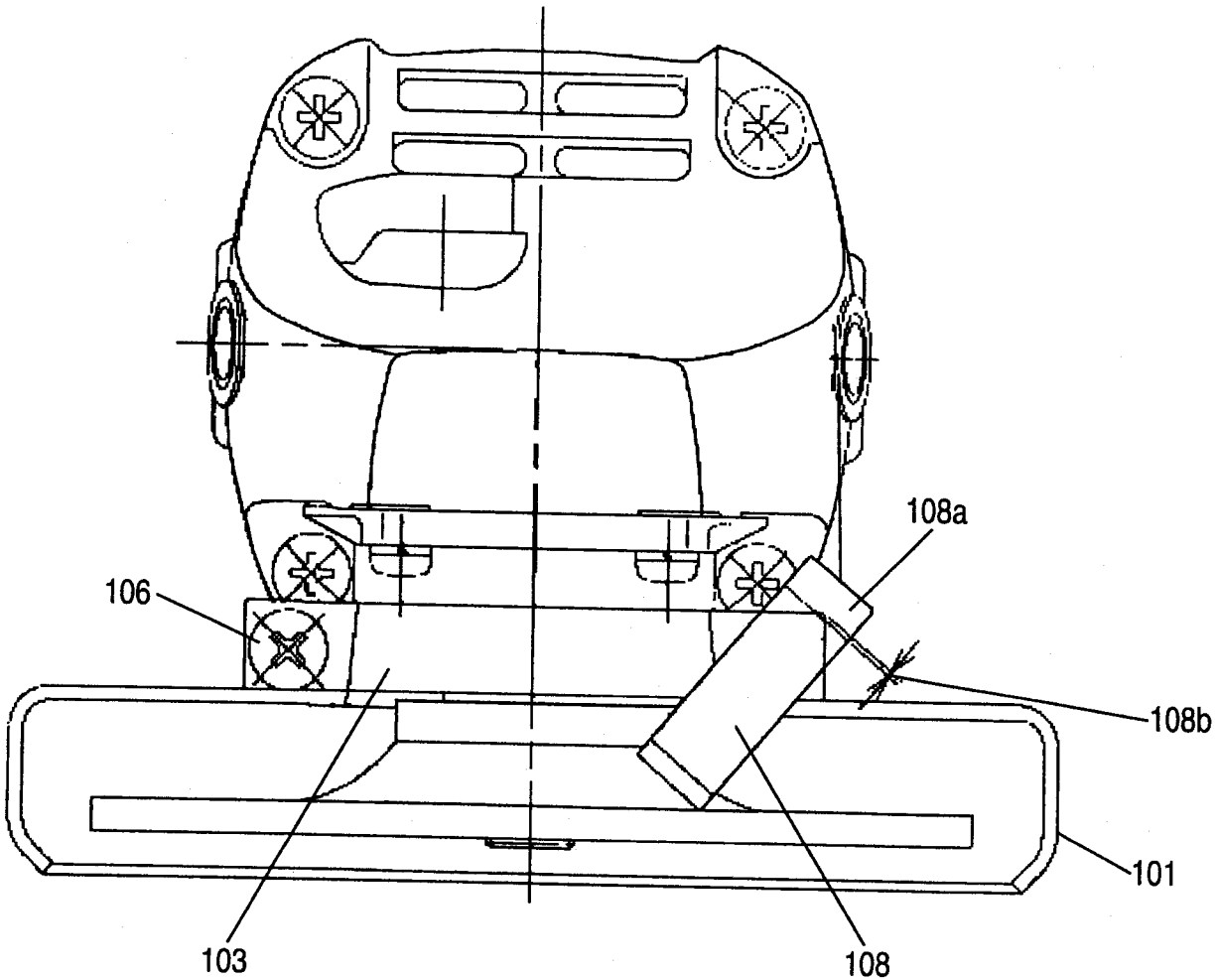
FIG. 16 is a view showing a pivot limit of an attachment-detachment lever of the wheel guard holding structure shown in FIG. 18 and a dimensional clearance with respect to a fastening band.
Figure 17:
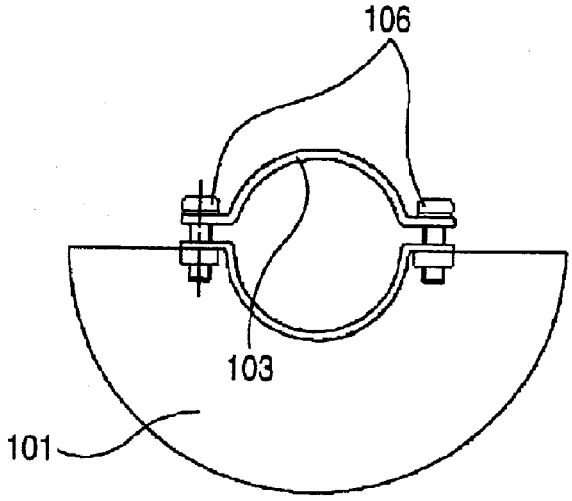
FIG. 17 illustrates a related-art wheel guard holding structure with two fastening screws.
Figure 18:
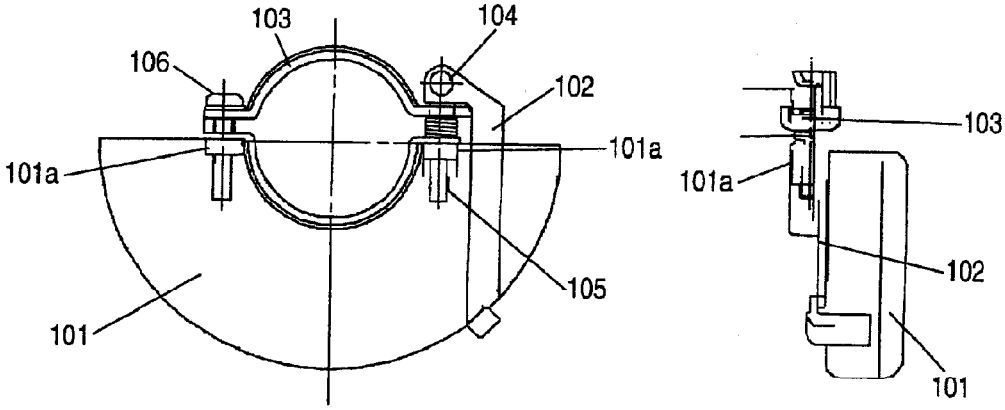
FIG. 18 illustrates a related-art wheel guard holding structure allowing position adjustment by means of a lever.

FIG. 11 illustrates a wheel guard holding structure which is an improvement of the related-art wheel guard unit shown in FIG. 18. FIG. 12 is a partially enlarged cross-sectional view of the wheel guard holding structure taken along the horizontal direction when the wheel guard is attached. FIG. 13 is a partially enlarged cross-sectional view of the wheel guard holding structure taken along the vertical direction when the wheel guard is attached. FIG. 14 is a partially enlarged cross-sectional view of the wheel guard holding structure taken along the horizontal direction when the wheel guard is detached. FIG. 15 illustrates a wheel guard holding structure which is an improvement of the related-art wheel guard unit shown in FIG. 17. FIG. 16 is a view showing a pivot limit of the attachment-detachment lever 108 when it is moved during the use of the power tool, also showing a latched area between the fastening band and the attachment-detachment lever at the pivot limit.

The wheel guard unit shown in FIG. 11 includes, similarly to the related-art components shown in FIG. 18, the wheel guard 101, the lever 102, the fastening band 103, the fulcrum shaft 104, the screw pin 105, and the screws 106. And, the screw 106 and the nut 101*a* are dismounted from the related-art wheel guard holding structure shown in FIG. 18. Instead of these components, a pin guide 107 is penetrated to holes of the wheel guard 101 and the fastening band 103 from which the screw 106 is dismounted, and an end portion of the pin guide 107 close to the wheel guard 101 is caulked. Other fastening mechanisms or other processing methods other than the caulking, such as a bolt-and-nut mechanism or a retaining ring, may be used. A hole is formed in the pin guide 107. A hole of the attachment-detachment lever 108 is aligned with the hole of the pin guide 107, the fulcrum shaft 104 is attached thereto, and the fulcrum shaft 104 is retained by a retaining ring 109. In a state of being attached to a power tool, the attachment-detachment lever 108 and the lever 102 are positioned as shown in the upper part of the drawing.

Here, when the lever 102 is pivoted frontward of the wheel guard 101 about the fulcrum shaft 104, the lever 102 is slid over the surface of the fastening band 103. At this time, since the lever 102 moves with respect to the fulcrum shaft in the direction where a distance thereof to the sliding surface decreases, the elastic deformation amount of the fastening band 103 is relaxed, and thus, the fastening force of the wheel guard 101 and the fastening band 103 with respect to the power tool is decreased. Therefore, the wheel guard 101 can be pivoted along the outer circumference of an attachment surface of the power tool. When the wheel guard 101 is attached, the attachment is carried out by moving the lever 102 to be pivoted backward to the wheel guard 101 about the fulcrum shaft 104.

The attachment-detachment lever 108 is fixed through a clamping between a fixed surface 108*a* of the attachment-detachment lever 108 and the caulking portion 107*a* of the pin guide 107 on condition that the fastening band 103 is in close contact with the wheel guard 101. Since the attachment-detachment lever 108 is pivotable about the axis of the pin guide 107, when the attachment-detachment lever is pivoted in the grinding direction as shown in the lower part of FIG. 11, the fixed surface 108*a* is opened and a detachment margin 110 as shown in FIG. 14 can be obtained.

Although the attachment and detachment of the wheel guard 101 is possible by simply pivoting the attachment-detachment lever 108, since the fastening force of the fastening band 103 is practically set to be strong so that the wheel guard 101 as the safety device is not easily detached, the operating force of the attachment-detachment lever 108 is likely to increase excessively. Therefore, by first operating the lever 102 in the direction of decreasing the fastening force of the fastening band 103 and then operating the attachment-detachment lever 108, the attachment-detachment lever 108 can be operated with a small force. Since such a series of operations requires two operations in different directions to detach the wheel guard 101, not a single operation, an erroneous operation can be prevented. Therefore, by preliminarily setting the length of the attachment-detachment lever 108 to be short so that the attachment-detachment lever 108 is prevented form being pivoted only by the human force, it is possible to provide a surely safety function.

When the wheel guard 101 is attached, by following the reverse order of the detachment operation, the attachment can be easily carried out without using an additional tool.

FIG. 15 illustrates a wheel guard holding structure improved from the related-art wheel guard unit shown in FIG. 17. This wheel guard holding structure provides the similar function as the wheel guard holding structure shown in FIG. 11.

Moreover, by providing a structure in which only a dimensional clearance 108*b* of the fixed surface 108*a* remains with respect to the fastening band 103 at the pivot limit shown in FIG. 16 even when the attachment-detachment lever 108 is pivoted in response to vibration during the use of the power tool, it is possible to prevent unexpected detachment of the wheel guard 101.

This application claims priority from Japanese Patent Application No. 2007-301899 filed on Nov. 21, 2007, and from Japanese Patent Application No. 2008-037863 filed on Feb. 19, 2008, the entire contents of which are incorporated herein by reference.

Industrial Applicability

According to an aspect of the present invention, there is provided a power tool having excellent workability without deteriorating the operability, and there is provided a power tool having a wheel guard holding structure allowing a wheel guard to be attached and detached to and from a power tool body without using an additional tool.

The invention claimed is:

1. A power tool comprising:

a wheel guard that is detachably attached to an attachment portion of the power tool having a tool bit that is driven to rotate;

a fastening portion that is connected to the wheel guard; and a manipulation lever that is connected to the fastening portion at one end of the manipulation lever so that the fastening portion is fastened to or released from the attachment portion by operating the manipulation lever, wherein the manipulation lever is moved to a first position in which the fastening portion is fixed to the attachment portion and to a second position in which the fastening portion is pivotable with respect to the attachment portion, wherein, when the manipulation lever is positioned at the first position, the other end of the manipulation lever is positioned at an outer circumference of the wheel guard, wherein the fastening portion has a projection portion extending therefrom in a direction approximately perpendicular to the attachment portion, and wherein the projection portion comes into contact with an object material to isolate the manipulation lever therefrom.

2. The power tool according to claim 1, wherein the fastening portion is connected to the wheel guard by a threading member, and wherein the fastening portion has a guide portion that is provided to restrict a movement of the manipulation lever in a threading direction of the threading member.

3. The power tool according to claim 1 further comprising:

an attachment-detachment lever that is provided to the fastening portion or the wheel guard, wherein the attachment-detachment lever is operated to attach or detach the wheel guard.

4. The power tool according to claim 3, wherein, to attach or detach the wheel guard, the attachment-detachment lever is operated after the manipulation lever is operated.

5. The power tool according to claim 3, wherein a latch margin of the attachment-detachment lever with respect to the fastening portion is set large enough for the wheel guard to not be detached when the attachment-detachment lever is unintendedly moved.

6. A power tool comprising:

a tool bit configured to be driven to rotate;

a wheel guard that is detachably attached to an attachment shaft of the power tool;

a fastening band that is connected to the wheel guard; and a manipulation lever that is connected to the fastening band at one end of the manipulation lever so that the fastening band is fastened to or released from the attachment shaft by operating the manipulation lever, wherein the manipulation lever extends along a front surface of the wheel guard to an outer side surface of the wheel guard in a radial direction of the wheel guard and further extends downward in a direction of the attachment shaft and along the outer side surface of the wheel guard.

7. The power tool according to claim 6, wherein the manipulation lever is positioned upper to a lower end portion of the wheel guard.

* * * * *